US007987795B2

(12) United States Patent
Hedegaard

(10) Patent No.: US 7,987,795 B2
(45) Date of Patent: Aug. 2, 2011

(54) MINK-FOX TRANSPORTATION SYSTEM FOR INDIVIDUAL TRANSFER/TRANSPORT IN CONNECTION WITH THE PRODUCTION OF MINK/FOX PELTS

(75) Inventor: Jens Hedegaard, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 0 days.

(21) Appl. No.: 12/279,701

(22) PCT Filed: Feb. 14, 2007

(86) PCT No.: PCT/DK2007/050021

§ 371 (c)(1), (2), (4) Date: Sep. 12, 2008

(87) PCT Pub. No.: WO2007/093185

PCT Pub. Date: Aug. 23, 2007

(65) Prior Publication Data

US 2009/0019898 A1 Jan. 22, 2009

(30) Foreign Application Priority Data

Feb. 15, 2006 (DK) ..... 2006 00219

(51) Int. Cl.
*B61B 13/04* (2006.01)
*E01B 25/08* (2006.01)
*C14B 1/00* (2006.01)

(52) U.S. Cl. ..... 104/119; 69/22; 104/88.01; 105/144; 238/10 R; 238/127; 238/128

(58) Field of Classification Search ..... 104/88.01, 104/118, 119; 105/144; 238/122, 127, 128, 238/10 A, 10 E, 10 F, 10 R, 22
See application file for complete search history.

(56) References Cited

U.S. PATENT DOCUMENTS

| | | | | |
|---|---|---|---|---|
| 5,735,214 | A * | 4/1998 | Tsuboi | 105/29.1 |
| 6,338,573 | B1 * | 1/2002 | Michioka et al. | 384/45 |
| 6,601,774 | B1 | 8/2003 | Kasimoff | |
| 2007/0061979 | A1 * | 3/2007 | Hedegaard | 8/94.16 |

FOREIGN PATENT DOCUMENTS

| | | | |
|---|---|---|---|
| GB | 1 410 652 | A | 10/1975 |
| WO | 2004/103866 | A2 | 12/2004 |
| WO | 2005/026394 | A1 | 3/2005 |
| WO | WO 2008064685 | * | 6/2008 |

* cited by examiner

*Primary Examiner* — S. Joseph Morano
*Assistant Examiner* — Zachary Kuhfuss
(74) *Attorney, Agent, or Firm* — Roberts Mlotkowski Safran & Cole, P.C.; David S. Safran

(57) ABSTRACT

A mink/fox transportation system (2) for individual transport in connection with the production of mink/fox furs, for example, the transport of upright-standing expansion pelt boards (4), with or without tanned, or tanned and dried pelts, to one or more relevant receiving stations (170, 172), has at least one, preferably a plurality, of self-driven traction units/carriages (10) driven along a predetermined transport path in the form of a track (6) which is formed of track elements (8,8',8'',8''') that have been assembled together configured to the arrangement of the particular production facility. The traction units/carriages (10) have a housing (12) with an upwardly-facing side (20) in which an opening (14) is formed for receiving a blunt part (18) extending from the foot end (16) of the pelt board, or surrounds a smaller part of the whole of the foot end of a pelt board.

19 Claims, 14 Drawing Sheets

74
62
29
65
94
96
96
94
96
94
96
94

MINK-FOX TRANSPORTATION SYSTEM FOR INDIVIDUAL TRANSFER/TRANSPORT IN CONNECTION WITH THE PRODUCTION OF MINK/FOX PELTS

BACKGROUND OF THE INVENTION

1. Field of Invention

The present invention relates to a mink/fox transportation system for individual transfer/transport in connection with the production of mink/fox pelts, such as the transfer/transport of mink/foxes, dead mink/foxes, mink/fox carcasses, feedstuffs and medicaments, cleaning equipment for mink/fox production, mink/fox pelts, upright-standing pelt boards, with or without tanned, or tanned and dried mink/fox pelts, and mink/fox pelts removed from pelt boards, between/to one or more relevant receiving stations for further transport, handling and/or processing.

2. Description of Related Art

Individual transfer and transport of mink/foxes in connection with the production of mink/fox pelts, medication of mink/foxes, transfer of living/dead mink/foxes, cleaning of cages etc., and the handling of pelt boards and pelts, and subsequent transfer and transport in within the fur trade, have hitherto being carried out manually. The same applies in connection with the feeding of mink/foxes which live in cages on farms, where the feedstuff is normally fed in on a manually-operated feeding carriage, which all in all is costly, since this involves manual work.

From International Patent Application Publication WO 2004/103866 there is known a vacuum system for internal transport of leather and various products between one processing station to the next in a tannery. The pelts are transported in tubes, where a vacuum is used to implement the transport of the pelts between a loading area and a delivery area, and is suitable only for the transport of pelts which are not stiff in any way, or which are drawn onto a pelt board, nor is the system suitable for transfer/transport of living animals.

SUMMARY OF THE INVENTION

The present invention is not limited to the kinds of embodiments which are described in the following, where the arrangement is described as an arrangement which is used for the transport of upright pelt boards, with or without loosely-mounted pelts, or mounted and dried mink pelts, but the invention shall, however, it is directed to use with respect to the production of mink and fox pelts.

For the sake of simplicity, in connection with the description of the arrangement according to the invention, a starting point is taken in the internal transport in a pelt processing plant of the above-mentioned pelt boards in upright position. The principal object of the invention is to provide an arrangement for carrying out a long series of individual transport tasks of different character, in connection with other functions related with animal breeding work, breeding and feeding of mink in connection with the production of mink and fox pelts, with the object of being able to carry out an effective and labour-saving production of mink and fox pelts.

This object is achieved with an arrangement of the type disclosed in the introduction, which is characterised in that it comprises at least one, though preferably a plurality, of self-driven traction units/carriages, driven along a transport track in the form of a rail determined beforehand, and which consists of rail elements placed together, said traction unit/carriage comprising a chassis with a loosely-securable relevant over-structure arranged for individual transfer/transport of mink/foxes, dead mink/foxes, mink carcasses, feedstuffs and medicaments for mink/foxes, cleaning equipment for mink/fox production, mink/fox pelts, upright-standing pelt boards, with or without tanned, or tanned and dried mink/fox pelts, and mink/fox pelts which have been removed from pelt boards.

The invention is thus a multi-functional arrangement for use in the individual transfer/transport in the various stages in the production and handling of mink/fox pelts, which is flexible in that the transport route can freely be selected in accordance with the space which is available at any given time, and also other production conditions. The implementation of a given individual transfer/transport task for which a relevant traction unit/carriage is dedicated determines the arrangement of a relevant over-structure which is placed on the chassis. There can thus appear a number of different types of over-structures intended for different tasks, all of which have in common that they can be mounted on the chassis on one of the traction units/carriages.

For the sake of simplicity, in the following, the description is limited solely in connection with the production of mink pelts, but the invention is also intended for use in the production of fox pelts.

The rail element, which is a part of the arrangement according to the invention, is characterised in that it can be formed of a plurality of shell-shaped, flattish, elongated elements placed together in a straight line or in a curved manner, said elements having a first end side, a second end side, first long side, a second long side, and in between and at a level over these an upwardly-facing side surface which is upwardly-convex and symmetrical around its axis, said side surface having a first and second side limitation, and where the first and second long sides comprise support flanges for contact against a fixed under-layer, and where the first and second long sides, between the support flanges and the first and second side limits of the upwardly-convex surface, have a first and a second substantially parallel, open V-shaped track, with a smaller linear bottom shape which is disposed substantially parallel with an imaginary vertical plane in the axis, and where the first side surface of the V-shaped track slopes toward and in connection with the support flanges, and where the second side of the V-shaped track surface slopes toward and is connected with the side limits of the upwardly-facing side surface.

The track element can with this embodiment thus be established without the use of professionally trained personnel being necessary for its laying-out, in that in reality the track is just as easy to lay out as the tracks for a model train or a track for electrically-driven model racing cars. Moreover, the orientation of the V-shaped tracks is important since it must be assumed that particles of dirt will arise in the space where the track elements are laid out, and which can settle on the upwardly-facing surface of same. Here, thought is given namely to sawdust which is used in connection with the pre-handling of the pelts which are mounted and secured on the pelt boards, and which can be detrimental regarding the drive wheels and support wheels on the traction units/carriages which, as will appear later, are cooperating with said V-shaped tracks, the orientation of which is such that particles and other dirt can not collect on the surfaces of these tracks, inasmuch as these are oriented either in a more or less vertical manner or sloping upwards or downwards. Out of regard for the occurrence of particles of dirt, the upwardly-facing side of the track element is also curved, whereby dirt which is lost during the transport of the pelt boards, and which falls down on the track element, will have a tendency to slide off the upwardly-facing surface and fall down on the under-layer on which the track is laid out.

The track's shell-shaped, flattish, elongated elements with a straight or a curved shape can be produced from numerous kinds of metals, but it is preferred that these are made of plastic, for example, injection-molded polypropylene, polycarbonate or another similarly suitable light material.

With the object of giving the track elements an adequate strength and bearing characteristic, the downwardly-facing side surfaces can with advantage be provided with longitudinal and transverse stiffening ribs.

With the object of enabling the track elements to be secured to a fast under-layer, e.g., a floor, the support flanges can comprise recesses/cut-outs for accommodating means for securing to a fast under-layer.

With the object of ensuring that after the laying-out on a fast under-layer the shell-shaped, flattish, elongated elements with a straight or curved shape are effectively secured with the facing end sides each in contact with each other, the respective track elements can comprise mutually cooperating locking means for the assembly and securing of these in the formation of a track.

Without renouncing other embodiments of the locking means for the track elements, it is noted that, in a preferred embodiment, these can be formed of the elongated, flattish first end sides of the elements comprising channels for introduction and securing of locking tongues protruding from the second end side of an adjoining element, and the locking tongues on at least two opposing side surfaces and the sides of the channels facing these sides can comprise cooperating serrations.

With the object of ensuring that the side surfaces of the track elements are of sufficient strength, the upwardly-facing side surface along the first and second side limitation can comprise similar recesses. By profiling said side limitations in such a manner, the strength characteristics in said areas of the track elements are increased.

The arrangement's traction unit/carriage can be configured in numerous ways, but without renouncing the right to other solutions cooperating with the track element, it can be mentioned that these can with advantage comprise a substantially rectangular, plate-formed chassis, the side of which facing towards the track element has an upwardly convex shape more or less congruent with the track element's upwardly-facing side, said chassis near each corner comprising a vertically oriented axle, the first end of which extends bluntly down under the chassis, and where said first ends are provided with substantially horizontal drive wheels and support wheels which cooperate with the V-shaped tracks, and the cross-sectional geometry of the horizontally-oriented wheels substantially corresponding to the V-shaped tracks, and said chassis further comprises an electrically-driven motor which, via a switch, is connected to a re-chargeable source of current, and where said drive motor's axle is connected to the one of the vertically-oriented axles via a friction connection, and where on said vertically-oriented axle there is also provided a first drive wheel which, via a drive connection, is connected to a corresponding second drive wheel on the same side of the chassis, and on which chassis the over-structure/housing for implementation of a relevant individual transport function is secured, for example, an over-structure for the supporting of upright-standing expansion pelt boards There is hereby achieved a self-driven traction unit/carriage which is supported in the track elements' V-shaped track, respectively on the drive wheels whose cross-sectional geometry substantially corresponds to the V-shaped tracks in the sides of the track element, the result being that the contact surfaces between drive wheels, support wheels and the sides of the V-shaped track do not get dirty during operation. This construction also results in good stability against lateral forces on the traction unit/carriage or on the over-structure placed on the chassis, for example, on an expansion pelt board placed in this in the upright position, where the center of gravity of the traction unit/carriage lie relatively high during transport on the track, inasmuch as the traction unit's drive and support wheels by engagement in the V-shaped track along the first and second side limit of the upwardly-convex shape are secured, so that the traction unit/carriage is not tipped over by said lateral forces. Moreover, there is achieved a self-driven transport system which is based on low current, which reduces the demands for electrical screening and other safety requirements in comparison with the use of high current in the rails for operation of the traction units/carriages.

With the object of being able to carry out the mounting and dismounting of the traction units/carriages comprised by the arrangement according to the invention, without having to carry out separation of the track for introduction of the drive and support wheels in the V-shaped tracks along the long sides of the track, the support wheels can be placed on the side of the chassis opposite the side with the traction wheels, and such that the support wheels are engaged in a lockable part of the chassis side, where said part can be swung out around an axle disposed over the support wheels and substantially parallel with the side of the chassis. The mounting of a traction unit/carriage on the track will hereby be able to be carried out without it being necessary to separate the track, in that the support wheels can merely be swung out during passage of the first and second side limits of the upwardly convex side surface in the mounting of a relevant traction unit/carriage on the track. Moreover, with this construction, it will be possible to mount/remove one or more traction units/carriages on/from the track without disturbing the operation of other carriages existing on the track.

With the object of being able to carry out a quick mounting and removal of the traction units on and from the track, the lockable part can comprise a manually-operated element for the release and swinging-out of the lockable part at an angle in relation to a substantially vertically-oriented locked position.

With the object of ensuring a charging-up of the traction units/carriages when these are lined up in waiting position, the re-chargeable source of current can be placed in a casing in the chassis, the outer side of which protrudes through one of the sides of the housing which is disposed parallel with the one of the track element's long sides, and said outer side of the casing comprising contact surfaces which cooperate with the contact surfaces of a cooperating external charging unit placed at a relevant long side of the track element.

It is hereby achieved that the re-chargeable source of current can be charged automatically, for example, during periods when these are place in a "waiting queue", for example, in connection with a "bottle neck" in the production line. The re-chargeable source of current can also be provided with a control unit for the control of the re-charging of the re-chargeable source of current by the external charging unit, so that the current source is not "over-charged" or damaged.

With the object of ensuring a relevantly desired control of the operation of the respective traction units/carriages, the traction units/carriages can comprise a second control unit for the control of the electrically-driven motor. In special cases this control unit can, via a wireless signal transmission unit, stand in connection with a central control unit which, in association with other signal generators along the track, effect the control of the operation of the individual traction units' electrically-driven motors, and other mechanical functions which are related to the relevant over-structure which is placed on a traction unit.

With object of ensuring that the drive units in the respective traction units/carriages are deactivated in the cases where the units/carriages are lined up after one another on the track element, during charging-up or in waiting position with the above-mentioned "bottle neck" in the production line, the switch can be a microswitch which is activated/deactivated via a piece of spring steel which is housed in the housing and in contact with the activation point of the microswitch, and where the free end of the spring steel element is in contact with the one end of a displaceable pin provided in the housing, the other end of said pin protruding through the housing as foremost point of the traction unit/carriage.

It is hereby achieved, in combination with the side of the housing opposite the side with the protruding displaceable pin being more or less vertical, that the traction units/carriages, concurrently when these reach a lining-up area, are stopped automatically, inasmuch as the displaceably housed pin, when colliding with the side of the housing of the traction unit/carriage standing in front, will influence the spring steel element and herewith deactivate the microswitch for stopping the electric motor of the traction units/carriage, whereby the driving of the traction unit/carriage is stopped. When the traction unit/carriage standing in front of the now stopped traction unit/carriage is driven away, the pressure on the displaceable pin is relieved, whereby the microswitch will close the circuit between the traction unit/the carriage's electric motor and the re-chargeable source of current, whereby the traction unit/carriage is set in motion and driven forward until it is stopped by pressure on the displaceable pin.

With the object of being able to stop the traction units/carriages in a desired position along the track element, for example, in connection with charging stations placed along the track, at the side of the track there can be at least one releasable rail bracket on which there is provided a displaceable or pivot arm at the same level as the displaceable pin, and which can be activated between a first inactive position, where the arm is disposed outside the track element and the area of operation of the traction units/carriages, and a second active position where the arm is oriented transversely to the track element for influencing the displaceable pin.

It hereby becomes possible, for example, to carry out a charging of the current source of the traction unit/the carriage at different positions along the track element. For example, the activation of the pivot arm, during the periods when the arrangement is not in use, e.g., at night, could be controlled by a timer unit or other control unit so that the arm, after a given period in the swung-out position, where it stops the movement of the traction unit, the current source of which is charged up, is swung briefly to the position parallel with the track element and back again to the swung-out position for the stopping of the next following traction unit/carriage for re-charging of its chargeable current source.

It is thus preferred to place one or more of these displaceable or pivot arms, so that at a suitable distance from these arms, and preferably on the opposite side of the track element, there exists at least one charging station which cooperates with the traction unit/carriage for the re-charging of the current source, so that re-charging of the transport arrangement's traction units/carriages can take place continuously.

In one embodiment of the arrangement according to the invention, where this is intended for the transport of upright-standing pelt boards, including expansion pelt boards, without pelts or with loosely mounted mink pelts, with or without tanned mink pelts, between one or more relevant collection and receiving stations for further transport, handling and/or storage, for this individual transport task the arrangement is provided with a relevant over-structure which will be described in the following.

However, before this part of the invention is disclosed, a description will be provided of its background. Thus in the following there will be provided definitions and descriptions of some of the elements and arrangements which are employed by modern fur manufacturers.

A drying unit and an expandable and collapsible distension element/pelt board, in the following also referred to as expansion pelt boards, are disclosed in International Patent Application Publication WO2005/026394. The expansion board can be described as a distension element/pelt board which has a longitudinal axis, a first transverse axis (breadth axis) and a second transverse axis (height axis), a front end for engaging the nose end of a pelt, and a foot end which is preferably terminated at right-angles in relation to the longitudinal axis of the board, and where the distension element/the board has at least a first and a second convex surface with an open structure which defines a cavity, and where said surfaces of the board are configured in a substantially symmetrical manner around at least two of the defined axes, and where the board comprises at least one opening to the cavity in the foot end. The distension element/board typically is formed, in practice, of two elongated half-shells with convex surfaces having an open structure which, in combination with a displaceable locking and distension element in the board's longitudinal direction, form a cavity from which the air under the open structure can be changed via an opening in the foot end during the drying process.

The convex configuration of the surface of the distension element in combination with its open structure has the result that the fastening of a pelt stretched on the distension element/pelt board of the type described here can be established by a holding bag or by wrapping, which after the pelt is stretched on the board is drawn over the fur side of the pelt and drawn towards the foot end of the board, so that at relevant areas of the pelt board the bag applies pressure which presses the leather side of the pelt against the convex open structures, whereby sufficient friction is created to enable the pelt to be fastened in the stretched position during the whole of the subsequent drying procedure.

The use of staples and other pelt-damaging holding means is hereby rendered superfluous, which means that the price for pelts dried on the newly-developed pelt boards is higher, with subsequent economic benefits for the seller.

The displaceable locking and distension element is displaceable between a forward position, where the distension element has its greatest circumference, and is the position in which the locking and distension element are in during the tanning and drying of pelts, and a drawn-back position where the expansion pelt board is "collapsed", so that the facing edges of the expansion board are in contact with each other. This results in a reduction of the expansion board's circumference, which is a very great advantage when the pelt shall subsequently be removed from the board, in that the work of pulling the pelt free from the surfaces of the board is considerably reduced, whereby the dried pelt is easy to remove.

In the removal of the pelt from the board, there is thus effected a displacement of the locking and distension element to the drawn-back position, whereby the expansion pelt board "collapses" with a subsequent smaller reduction in the circumference of the board, whereby the work of pulling the dried pelt from the collapsed expansion board is eased to a significant degree, as compared with the pulling-free of a dried pelt from a conventional pelt board.

The locking and distension element of the expansion board also comprises a blunt part extending from the foot end of the distension element/pelt board, and which herewith provides an engagement area for holding means and the like which are used in connection with the fastening and handling of the expansion board in a drying unit arranged for this purpose (more about this in the following), and in connection with the displacement of the locking and distension element between the drawn-back position and the forward position and vice versa.

With the object of being able to remove possible fat on the leather side of the pelt during the drying process, a layer of fat-absorbing material can, in certain cases, be placed between the convex open-structured surface of the board, which material is placed on the board before the drawing-over of the pelt. This material can typically be a bag made of fat-absorbing material, chiefly fat-absorbing paper with perforations, for example, in the form of a so-called pelt board inner bag, which will thus be lying between the surface of the board and the leather side of the pelt The subsequent drying of the pelt takes place in a drying unit comprising a carriage, the bed of which is built up as an air induction channel with a blower, where the upwardly-facing side surface comprises openings for accommodation of the blunt extending part on the locking and distension element, which is extending from the foot end of the expansion board with the tanned pelt, which is inserted into the drying unit for drying. The drying then takes place by placing the drying unit in a room with conditioned air, where the blower is activated, whereby a continuous exchanging of the air in the expansion board's cavity is effected via the air induction openings in the immediate vicinity of the openings for receiving the blunt extending parts on the locking and distension elements. The expansion pelt boards are placed and fastened in the drying unit in the upright position.

In addition to the advantages already mentioned, the expansion boards have the advantage that the handling of the pelt boards after the drying of the pelts is relatively limited, in that after the pelts have been mounted on the expansion pelt boards, these are transferred directly to the drying unit, after which this can be placed in the drying room with the desired air temperature and humidity, and the blowing of air into the cavities in the boards can commence by activation of the blower of the drying unit. The pelts are thus dried on the boards, which as described earlier are placed standing upright from the bed of the drying unit, and after the drying the boards are conveyed for removal of the boards from the unit.

The expansion pelt board typically appears in two configurations, a first configuration, which is intended for use in the mounting and drying of pelts from male animals, is elongated in fashion, and the shape of the board in relation to the longitudinal axis in the direction of the first transverse axis and the second transverse axis is more or less uniformly decreasing in the direction towards the front end, which is pointed but rounded-off, extending from an area of the expansion element near the foot end, where the shape of this around the first and the second transverse axis is more or less constant. Such a pelt board is thus referred to as a "male pelt board".

Expansion pelt boards intended for use in the mounting and drying of pelts from female animals are of a second configuration, but have the same fashion as those described above for male animals except that they are shorter, in that the boards for pelts from female animals do not comprise the area near the foot end, where the shape of this around the first and the second transverse axes is more or less constant. Such a board is thus referred to as a "female pelt board".

In the following, the "tanning" of a pelt is to be understood as a process comprised of the following steps: the mounting of a pelt on the board, chiefly with the leather side of the pelt facing towards the surface of the board, the stretching of the pelt on the board, and the fastening of the pelt in the stretched position on the board with the use of one or more types of holding means.

In the following, no distinction is made between the above-mentioned two embodiments of the pelt boards unless specific attention is drawn to the difference.

In the following, a "tanned" pelt shall be understood to be a pelt drawn onto the pelt board, stretched on the board and fastened in this position by one or more holding means.

The term "drying procedure" or drying of the pelt shall be understood to be a drying of the leather side of the pelt to a preferred degree whereby attack by mites (as is known from experience) can be precluded. The drying procedure is typically carried out by a continuous changing of the air in the cavity in the board by the blowing-in of dry air.

In the following, the "removal" of a pelt shall be understood to be the removing of a pelt which has been mounted, stretched and fastened in this position on the board during the drying procedure, typically after the pelt drying process has been concluded. The removal procedure also comprises the removal of any means which have been used for fastening the pelt in the stretched position on the pelt board.

The expansion pelt boards are developed to be able to be used a great number of times, and with the improved drying characteristics which are offered by these boards, the boards will be reused up to several times during the course of a pelt processing period.

When the dried pelt and the holding bag and pelt board inner bag have been removed, the pelt board is thus ready for reuse, but before a new pelt is mounted on the board for stretching (tanning), it will be necessary to provide the board with a new inner bag so that the possibility is hereby provided for the removal of fat from the leather side of the pelt during the drying.

Machines and devices have been developed for the mechanical mounting of pelt board inner bags, the mounting, stretching and fastening of pelts on expansion boards, and for the removal of the dried pelts from the expansion boards, which has resulted in a considerable saving of manual labor and herewith a better profitability in connection with the production of furs. These machines are based on the pelt board which is handled by the machine being conveyed to an operation area in the upright-standing position, and therefore, there have earlier been developed arrangements which are able to carry out automatic transfer of the boards in the upright position between the drying unit and means for the transport of these respectively to the pelt remover, the arrangement for the mounting of pelt-board inner bags, the tanning machine, and back to the drying unit. The means for the conveying of the expansion pelt boards have hitherto had a configuration which places great demands regarding the size and arrangement of the room in which the pelt-processing machines are placed, and which to a high degree have lacked that flexibility with regard to the positioning of machines which is required by modern fur producers.

The arrangement according to the present invention will thus also be particularly suitable for the solving or this individual transport task, and an over-structure on a traction unit/carriage for solving this task can with advantage comprise an opening for the accommodation of a smaller part of the foot end of the pelt board.

It is hereby achieved that the internal transport of the expansion boards can take place along that route which the workers at the fur producers find most expedient and less space-demanding. Moreover, considerably greater freedom is achieved with regard to the disposition of the individual machines which are involved in the handling/processing of the pelts.

In a second embodiment of the arrangement for transport of pelt boards in the upright-standing position, with or without loosely mounted or tanned or tanned and dried pelts, where said pelt boards are of the kind which comprise a nose end and a foot end, and where the board comprises a blunt part extending at least from the foot end and oriented along the longitudinal axis of the board, the arrangement is characteristic in that the upwardly-facing side of the over-structure comprises an opening which is arranged to accommodate the blunt part extending from the foot end of the board.

In a further embodiment of the arrangement, where this is intended for transport of upright-standing expansion pelt boards, with or without loosely mounted or tanned or tanned and dried pelts, where the expansion boards are of the kind which comprise a nose end and a foot end, and a locking and distension element with a blunt part extending from the foot end of the distension element/pelt board, and which herewith provides an area of engagement for holding means and the like, the arrangement is characteristic in that the upwardly-facing side of the over-structure comprises an opening which is arranged for the accommodation of the blunt part extending from the foot end of the expansion pelt board With the object of being able to detect whether an actual traction unit/carriage is the carrier of an expansion pelt board, the rail bracket can further comprise a detection unit for upright expansion boards placed on the housing.

There is hereby disclosed an arrangement which is able to carry out the internal transport of upright-standing expansion pelt boards between the different machines which are involved in the handling/processing of pelts, which is flexible with regard to the establishing and changing of transport paths, which is also easy to clean, and moreover does not require the same insulation as that required with the use of high voltage.

In the following, the invention is explained in more detail below with reference to the accompanying drawings.

DETAILED DESCRIPTION OF THE INVENTION

As already mentioned, the arrangement is described for individual transport within the production of mink/fox furs according to the invention, and on the basis of a single embodiment for this purpose, which is intended for transport of upright-standing expansion pelt boards 4.

Figure 1:
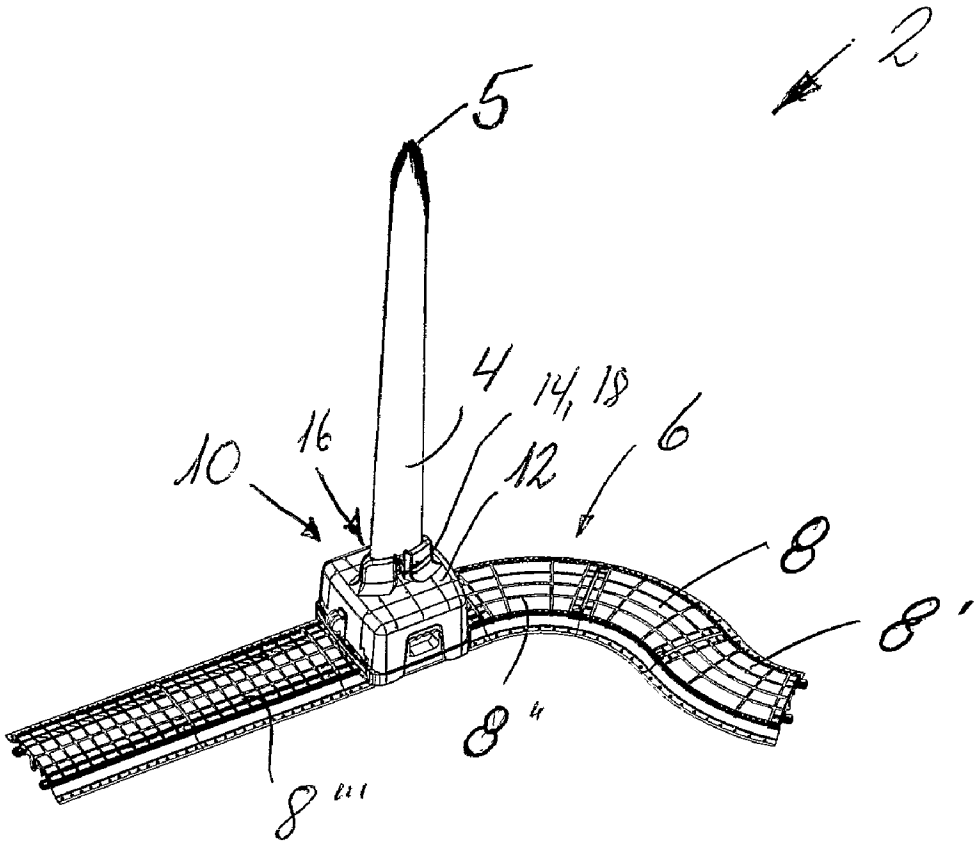
FIG. 1 is a perspective view seen at an angle from above of a first embodiment of a section of a track element and a traction unit/carriage associated with an arrangement for individual transport of upright-standing expansion pelt boards according to the invention.

In FIG. 1, there is shown a section of an arrangement 2 for transporting upright-standing expansion pelt boards 4 according to the invention. The figure shows a section seen at an angle from the front of a first embodiment of a track 6 formed of mutually connected track elements 8, 8', 8", 8''' and a traction unit/carriage 10 with a housing/over-structure 12 comprising an opening 14 for receiving a blunt part 18 extending from the lower end 16 of an expansion pelt board 4, whereby the expansion pelt board 4 is secured in the upright position on the traction unit/carriage 10. As will appear from FIG. 1, the track 6 can be formed of differently shaped, mutually-connected track elements with curved shape 8, 8', 8", and with a straight shape 8'''. The curved elements 8, 8', 8" can also have various degrees of curvature, and the straight elements 8''' can be constructed in various lengths.

Figure 2:
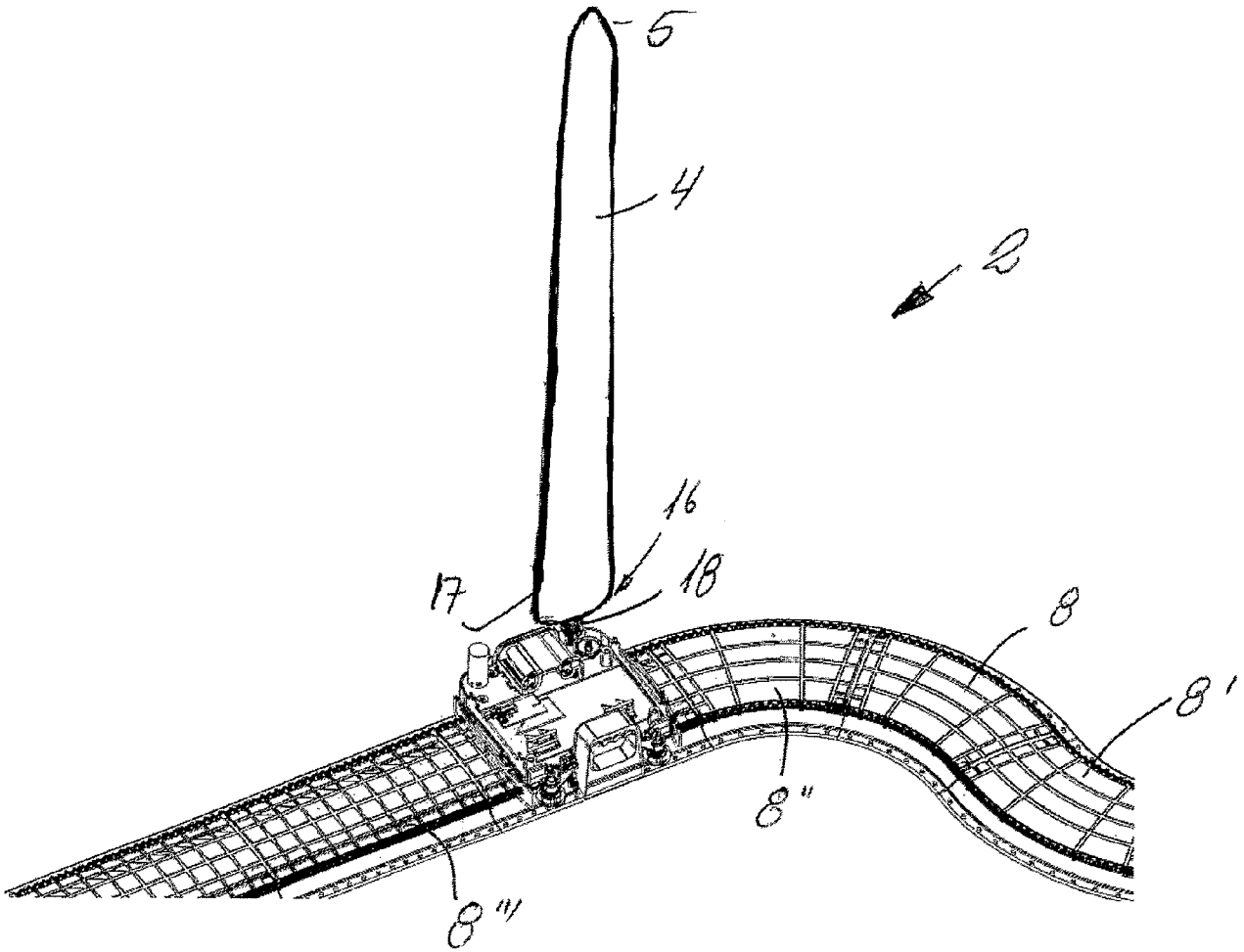
FIG. 2 shows the embodiment of FIG. 1, but where the housing/over-structure of the traction unit/carriage housing/over-structure is hidden.

FIG. 2 differs from FIG. 1 only in that the over-structure/housing 12 is not shown. In FIG. 2, the blunt part 18 extending at the lower end (the foot end) 16 of the expansion pelt board 4 is seen more clearly.

Figure 6:
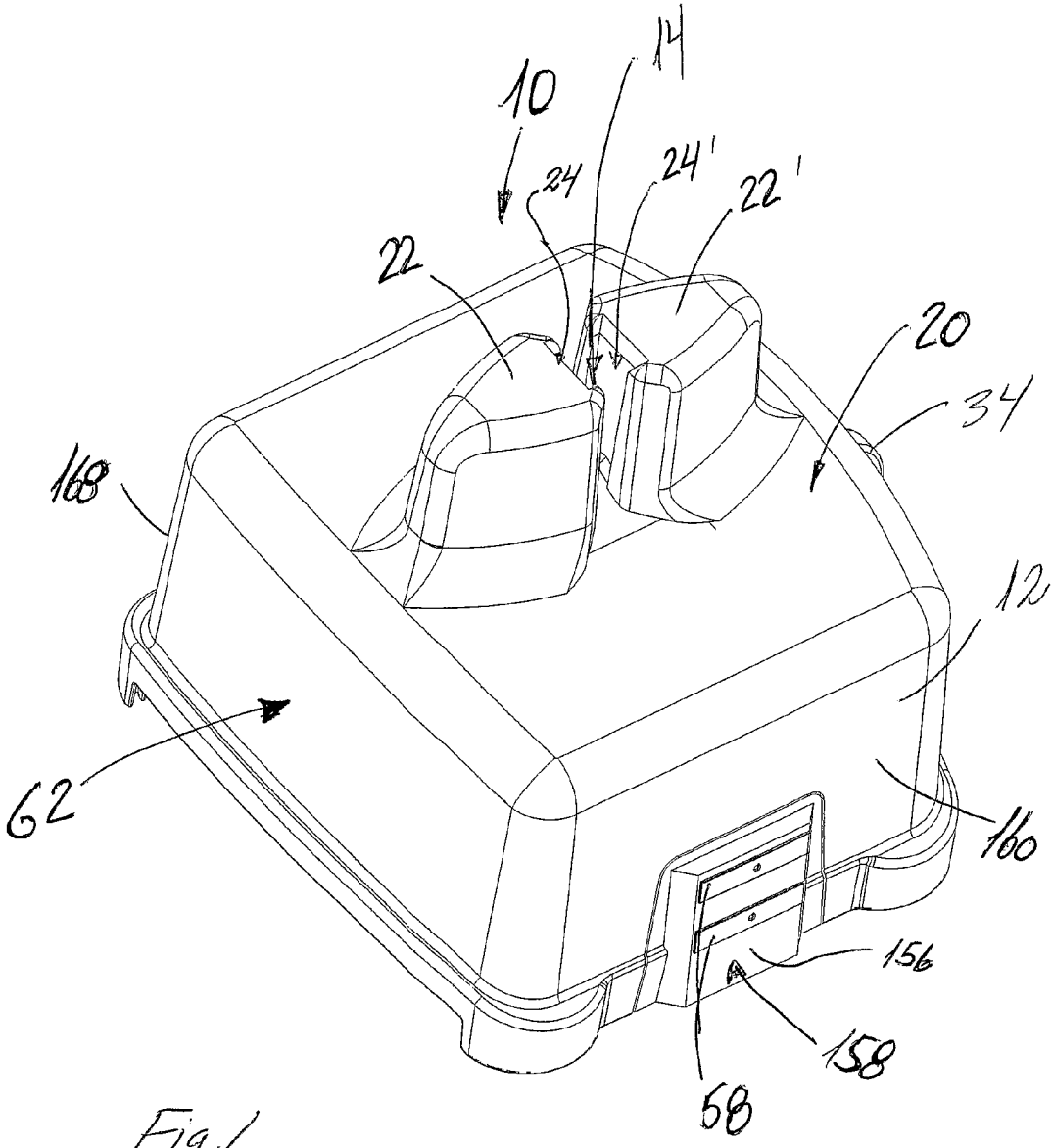
FIG. 6 is a perspective view of a traction unit/carriage for transport of expansion pelt boards in an upright position according to the invention.

As also appears from FIG. 1, and more clearly in FIG. 6, which is a perspective view of the traction unit/carriage 10 shown in FIG. 1 seen from above, the opening 14 for the insertion and fastening of the blunt part 18 extending from the lower end 16 of the expansion board is brought about on the top 20 of the housing by two similar, laterally-reversed, spaced upright parts 22, 22', the facing sides 24, 24' of which each comprise a track 26, 26' which in combination form the opening 14. The distance between the facing sides 24, 24' and the breadth of the tracks 26, 26' are configured to match the geometry of the blunt part 18 extending from the foot end 16 of the expansion pelt board, so that it is possible in an easy and simple manner to insert and remove an expansion board in and from the opening 14, but at the same time such that the expansion board is still held in an upright position during the transport.

Figure 3:
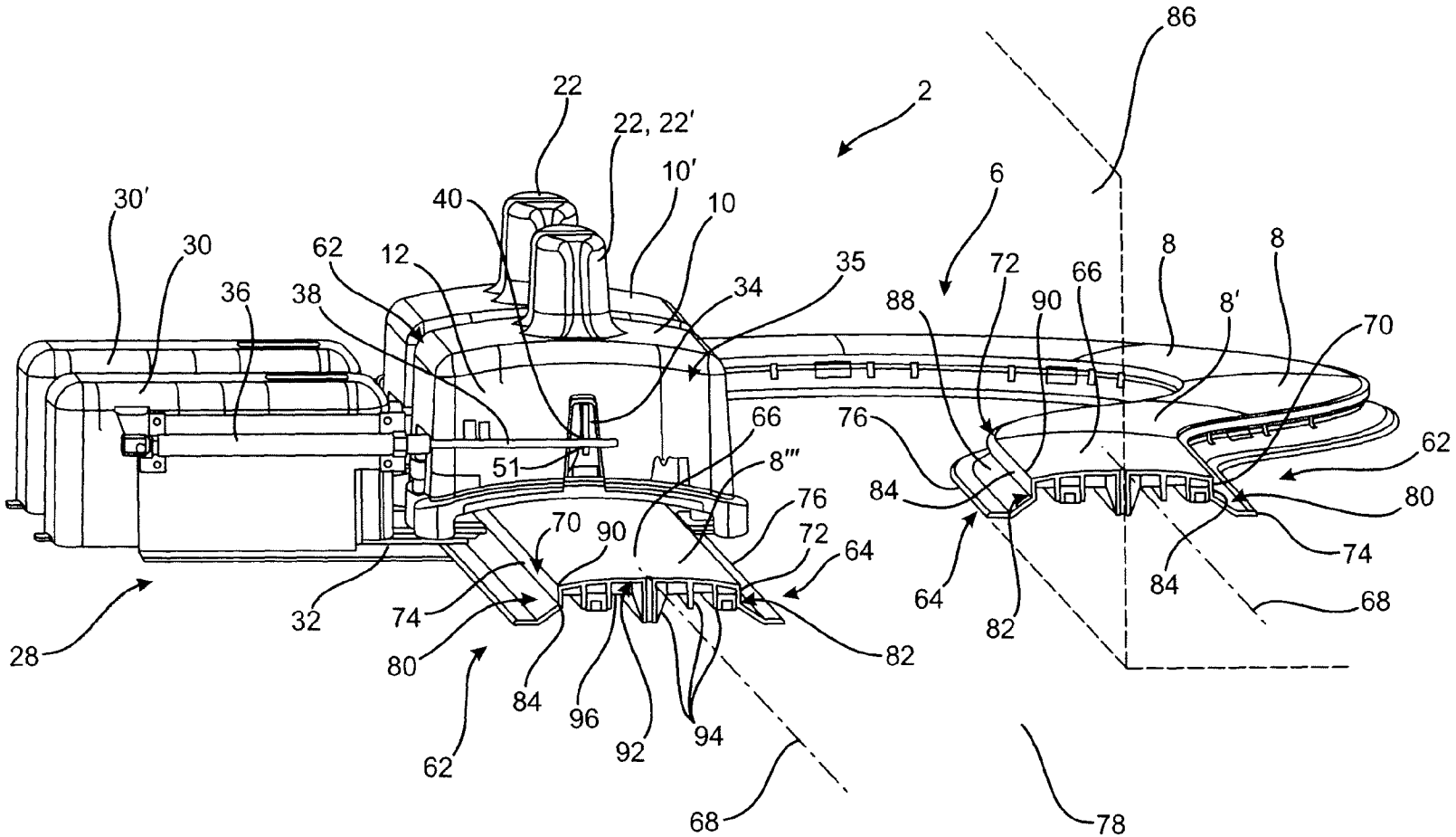
FIG. 3 is a perspective side view of the arrangement shown in FIG. 1 at an associated charging station.

In FIG. 3, which is a perspective view seen from the front of the arrangement 2 shown in FIG. 1 with an associated charging station 28. The charging station 28 comprises two charging units 30, 30' placed on a rail bracket 32 fastened to the track 6, see also FIG. 13. On the rail bracket 32, at a suitable distance in front of the charging units 30, 30', on a level with an extending part 34 on the front 35 of the housing 12, there is placed an arm 38 that is displaceable by a first actuator 36 which in the figure is displaced to an active position where it extends transversely to the track 6 and the traction unit/carriage 10, and is in contact with the foremost part of the part 34, and herewith in contact with a displaceable pin 40 in the part 34 and the housing 12, the free end of said pin extending through the part 34 (cf. FIG. 13, which in principle shows the same as FIG. 3, but where the housing/over-structure 12 is not shown on the foremost traction unit/carriage 10), which stands in connection with the free end 41 of a piece of spring steel 42, the opposite end 44 of which is anchored in the chassis 50, and where there is a microswitch 46 between the free end 41 and the anchored end 44 of the spring steel.

In the position shown, the microswitch 46 deactivates the electrical circuit between the electric motor 52 and a control unit 54 for controlling the re-charging of a chargeable current source 56, which is provided with contact points 58 (cf. FIG. 6) for engaging with contact rails 60 (cf. FIG. 13) on the charging units 30, 30'. In this position, there is thus effected a re-charging of the chargeable source of current 56 controlled by the control unit. It is noted that in a further unillustrated embodiment, the first actuator 36, with the displaceable arm 38 can be housed in the track element as a pivot arm which can be displaced by an actuator between a passive position, where the arm is lying on a level with or below the upwardly-facing side surface 66 of the track 6, and an active position where the pivot arm is standing upright from the upwardly-facing side surface 66 of the track 6 for contact with the part 34 on the front 35 of the housing 12.

The driving of the traction unit/carriage 10 can take place by the arm 38 being displaced by the actuator 36 to a passive position, where the arm is outside the track 6 and outside the area of action for the traction unit/carriage 10, whereby the load on the displaceable pin 40 is relieved, and herewith the load on the spring steel 42 and the microswitch 46, whereby the circuit to the drive motor 52 is closed via the control unit 54.

Figure 13:
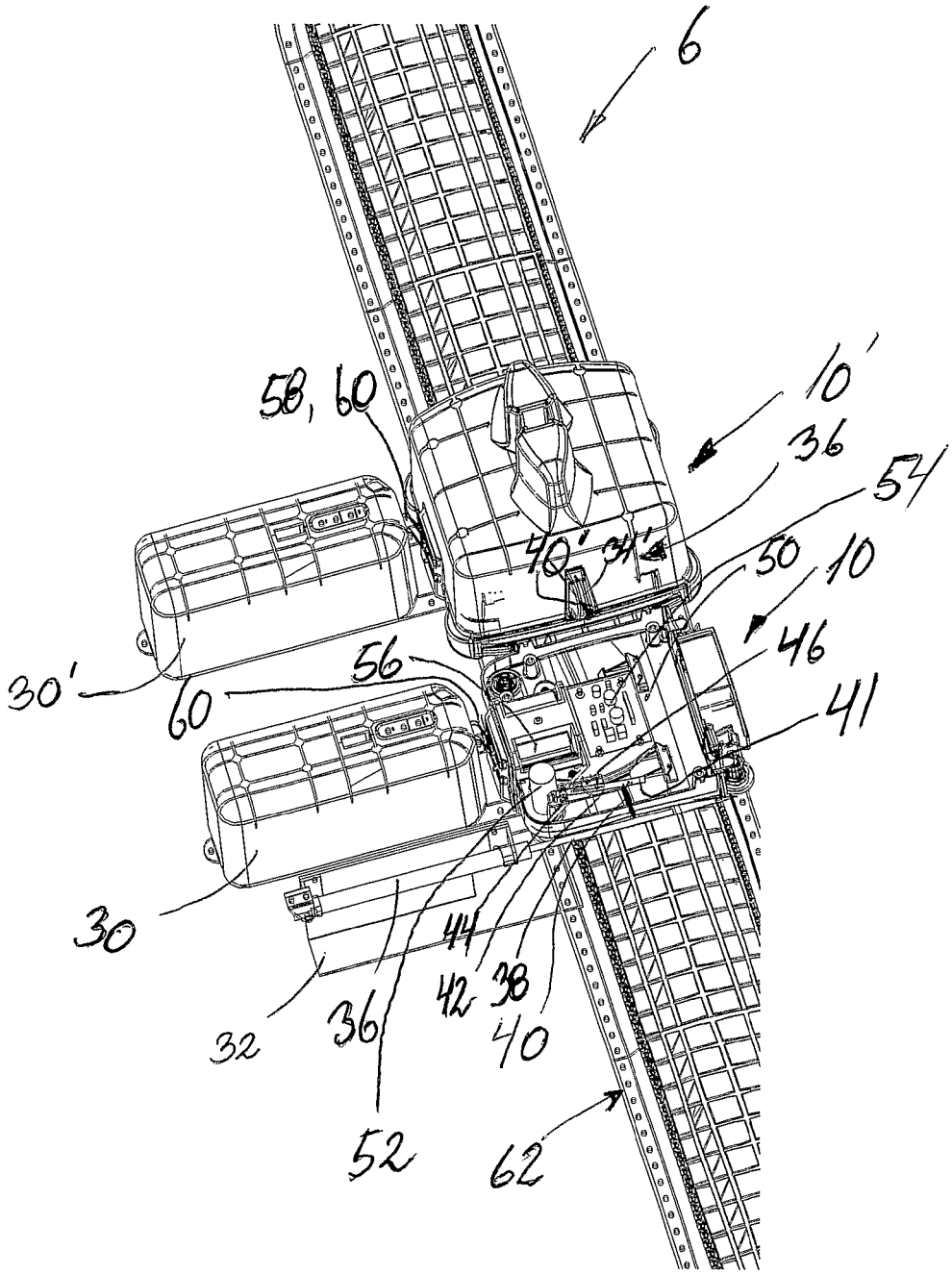
FIG. 13 is a perspective plan view of the arrangement shown in FIG. 3, but with the housing removed from the foremost traction unit/carriage.

As will appear from FIGS. 3 & 13, the driving of the traction unit/carriage 10' behind the foremost traction unit/carriage 10 is stopped opposite the charging station 30', where in the same manner there is effected a controlled charging of the chargeable source of current in the traction unit/carriage 10'. The stopping of the traction unit/carriage 10' takes place here by the displaceable pin 40' in the part 34' being pressed against the housing side 62 of the traction unit/carriage 10.

As will also appear from FIG. 3, the track 6 is comprised of a number of shell-shaped, flattish, elongated track elements 8, 8', 8" assembled together and extending in a curved manner, and elements 8'" which extend in a straight line. The elements comprise a first long side 62 and a second long side 64, and in between and at a level above these an upwardly-facing side surface 66 with a convex surface extending symmetrically upwards around its axis 68. The side surface 66 has a first and a second side edge 70, 72, and where the first and the second long side 62, 64 comprise support flanges 74, 76 for contact against a fixed under layer 78. As also appears from FIG. 3, the first and the second long sides 62, 64 between the support flanges 74, 76 and the first and second side edges 70, 72 of the upwardly convex shape 66, have a first and a second open substantially V-shaped track 80, 82, with a smaller straight bottom shape 84 which is disposed substantially parallel with an imaginary vertical plane 86 in the axis 68, and where the first side surface 88 of the V-shaped track is sloping towards and connected with the support flanges 74, 76, and where the second side surface 90 of the V-shaped track is sloping towards and connected with the side edges 70, 72 of the upwardly convex side surface 66 of the plurality of assembled, shell-shaped, flattish, elongated track elements 8, 8', 8" with a curved shape, and 8'" with a straight shape, which together form the track 6.

Figure 5:
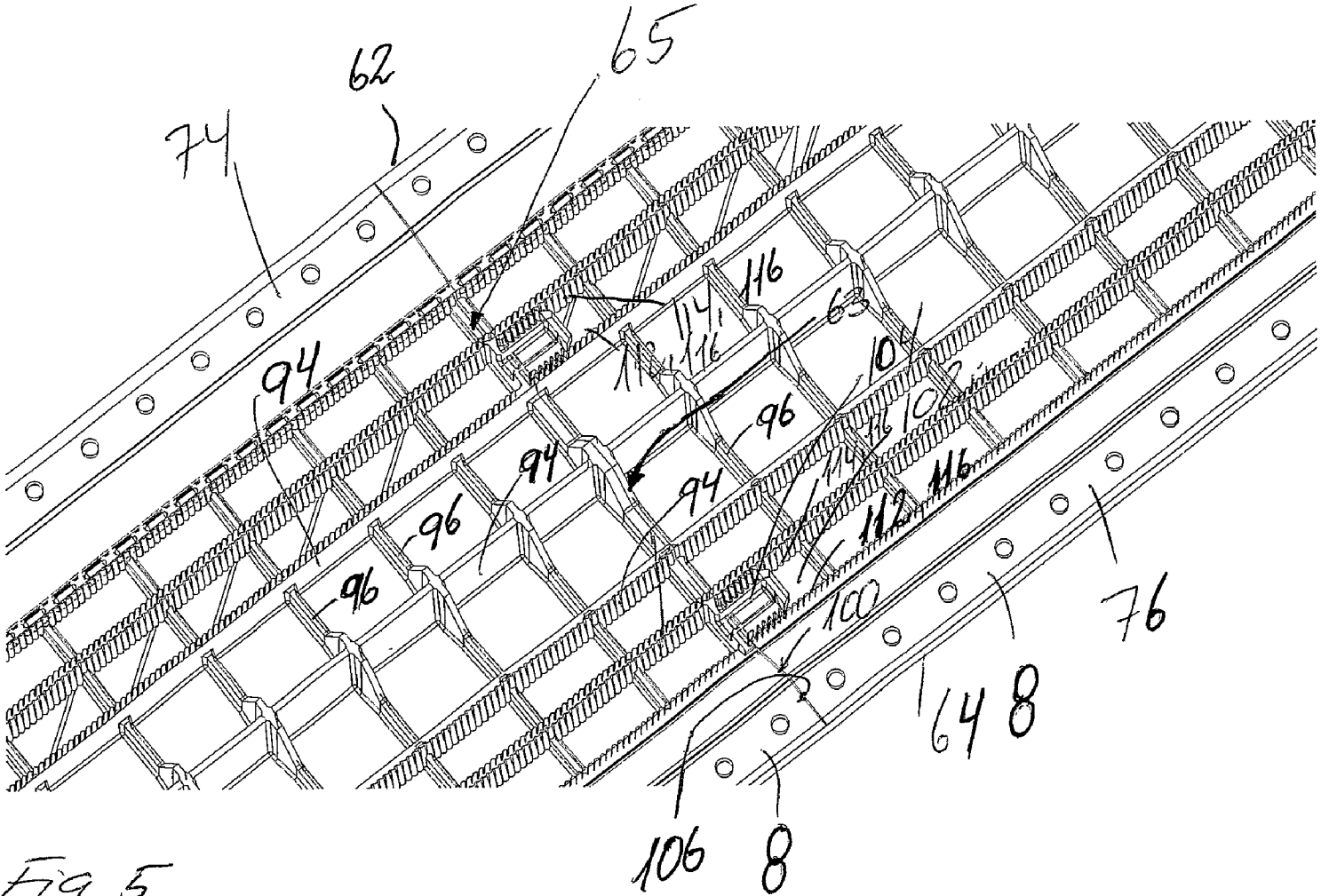
FIG. 5 is a perspective view seen from below of the assembly between two track elements.

As will also appear from FIG. 3, and even more clearly in FIG. 5, which is an under-side view of the assembly between two track elements 8, the downwardly-facing side surfaces 92 of the track elements are provided with longitudinal and transverse stiffening ribs 94, 96 for strengthening the bearing capacity of the track, and such that the track 6 is thus given a certain stiffness.

Figure 4:
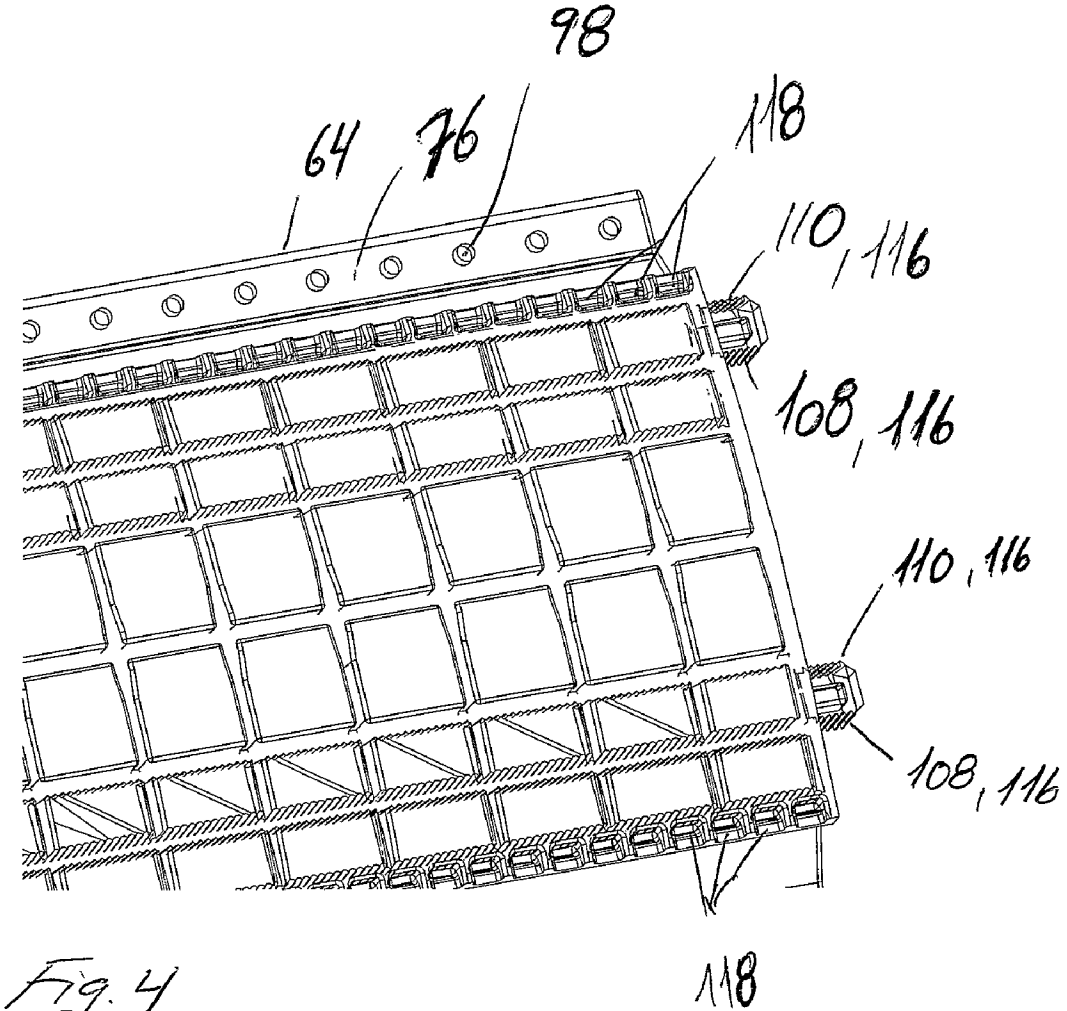
FIG. 4 is a perspective end view of a track element in accordance with the arrangement according to the invention.

As will also appear from FIGS. 4 and 5, the support flanges 74, 76 comprise recesses/cut-outs 98 for engaging securing means for the fastening of the track 6 to the fixed under layer 78.

The respective track elements 8, 8', 8", 8'" comprise mutually cooperating locking means for assembly and fastening of the elements in the formation of a track. In FIGS. 4 & 5, there is shown an embodiment of these locking means, where at the first end sides 100 of the track elements 8, 8', 8", 8'" the cooperating locking means comprise channels 102 for the introduction of locking tongues 104 protruding from the second end side 106 of an adjoining element. In order to ensure a good fastening ability between the tongues and the channel walls, on at least two opposing side surface 108, 119, and with these sides of the locking tongues facing sides of the channels 112, 114, the locking tongues 104 comprise serrations 116.

With the object of ensuring a desired stiffness of the first and the second side edge 70, 72 of the surface 66 of the track 6, the upwardly-facing side surface 66 is provided with similar recesses 118.

Figure 7:
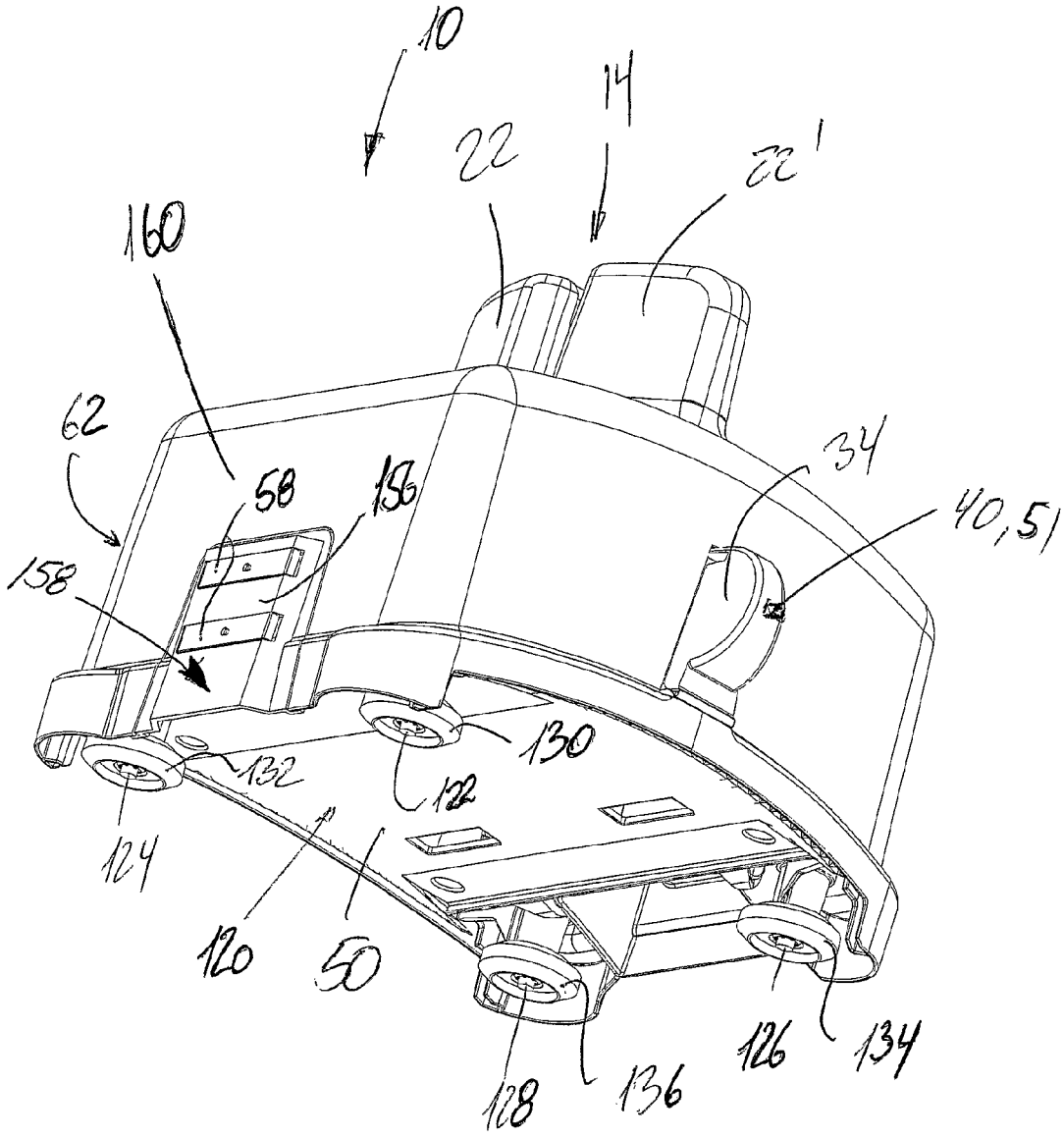
FIG. 7 is a perspective view seen at an angle from the front and from below of the embodiment of a traction unit/carriage according to the invention shown in FIG. 6.

In FIGS. 6 & 7, there is shown an embodiment of a traction unit/carriage 10 for the arrangement 2 according to the invention, where the housing/over-structure 12 is shown, respectively, at an angle from the rear and from above, and at an angle from the front seen from below. FIG. 6 has already been described above. In FIG. 7, where the traction unit/carriage 10 is seen at an angle from below, the underside 120 of the chassis 50 is seen, cf. FIG. 8, which is an end view of the chassis 50, but where the housing/over-structure 12 is removed.

The chassis 50 is plate-shaped with a substantially rectangular basic shape. The side 120 facing towards the track element 6 has an upwardly convex shape more or less congruent with the upwardly-facing side 66 of the track element. Near each corner, the chassis 50 comprises a substantially vertical axle 122, 124, 126, 128, the first end of which is bluntly extending down under the side 120 of the chassis 50 facing towards the track element 6, and the first end is provided with substantially horizontal drive wheels 130, 132 and support wheels 134, 136 which cooperate with the V-shaped track 80, 82, and which, as shown in FIG. 3 etc., the cross-sectional geometry of the horizontally-disposed wheels 130, 132, 134, 136 correspond to the cross-sectional geometry of the V-shaped track. The distance between the axles 122, 126, and the axles 124, 128 is thus determined so that the mutual distance between the periphery of the wheels 130, 134 and 132, 136 corresponds to the mutual distance between the vertical bottom shape 84 of the V-shaped track 80, 82.

Figure 8:
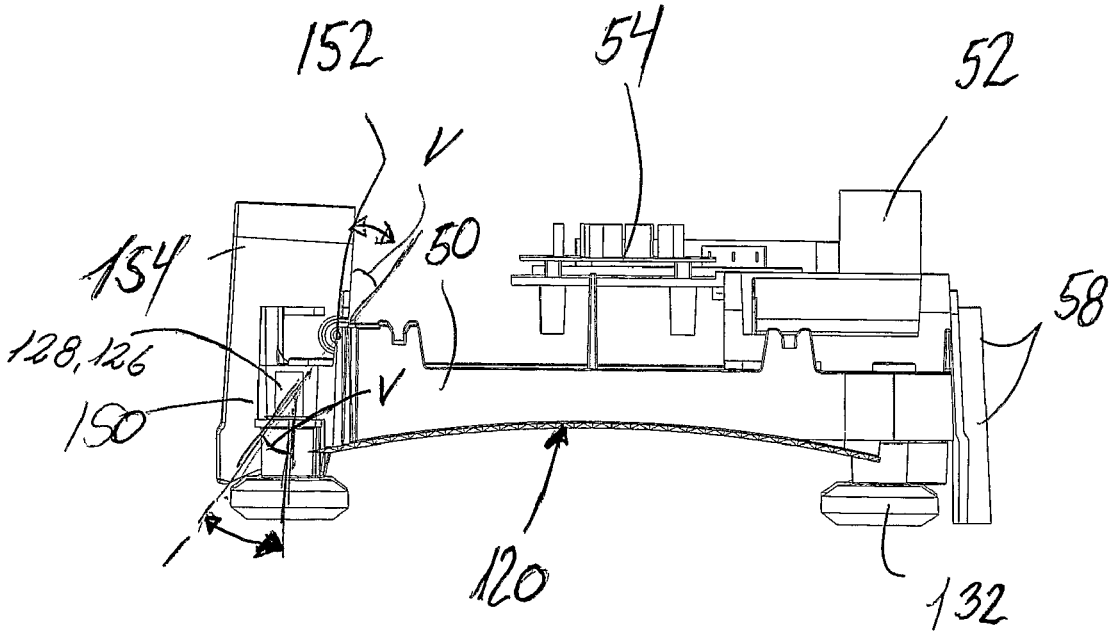
FIG. 8 is a perspective front view of the traction unit/carriage shown in FIG. 6 and FIG. 7, with the housing is removed.
Figure 9:
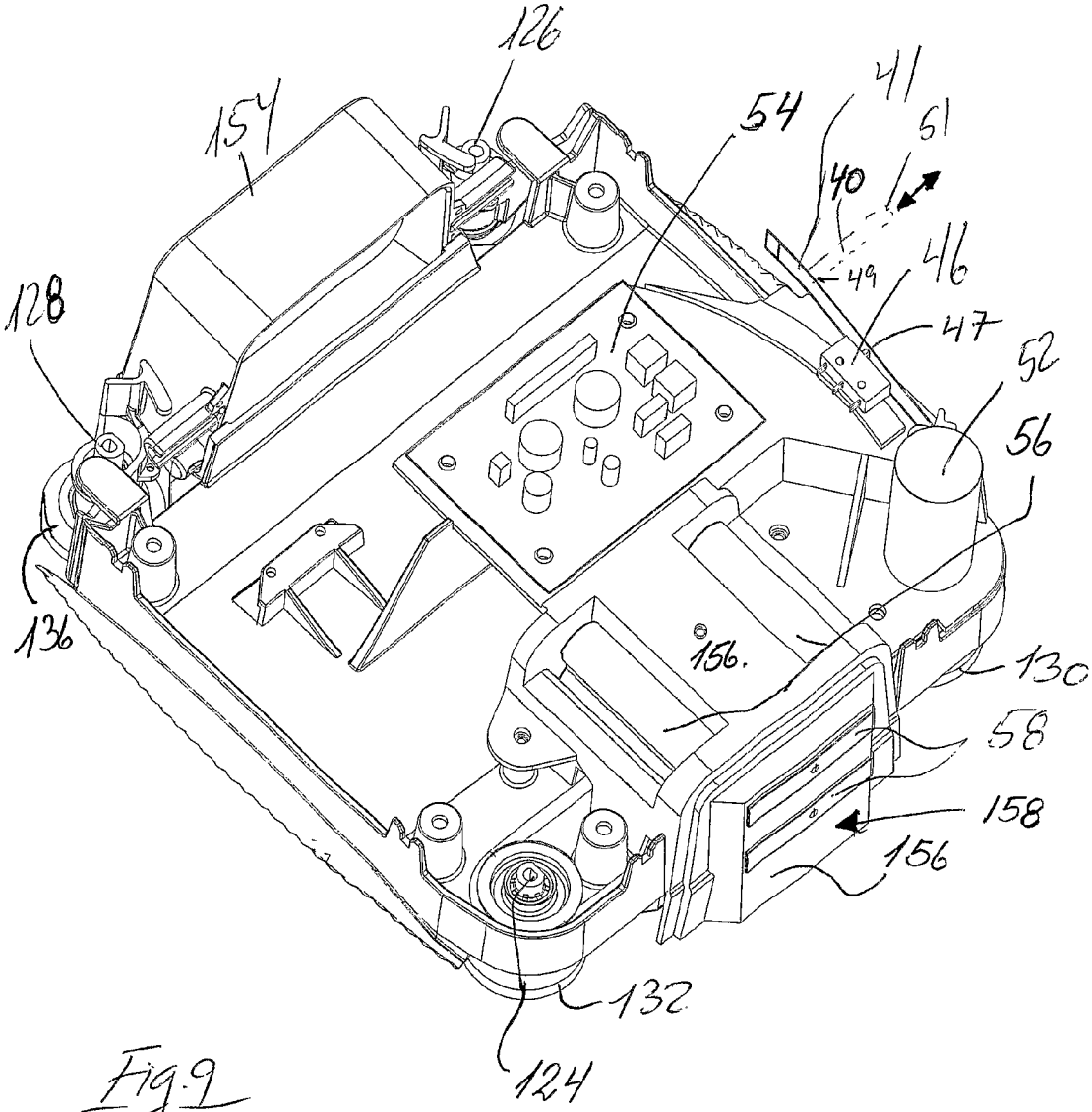
FIG. 9 is a perspective side view of the traction unit/carriage shown in FIG. 6 and FIG. 7, with the housing is removed.
Figure 10:
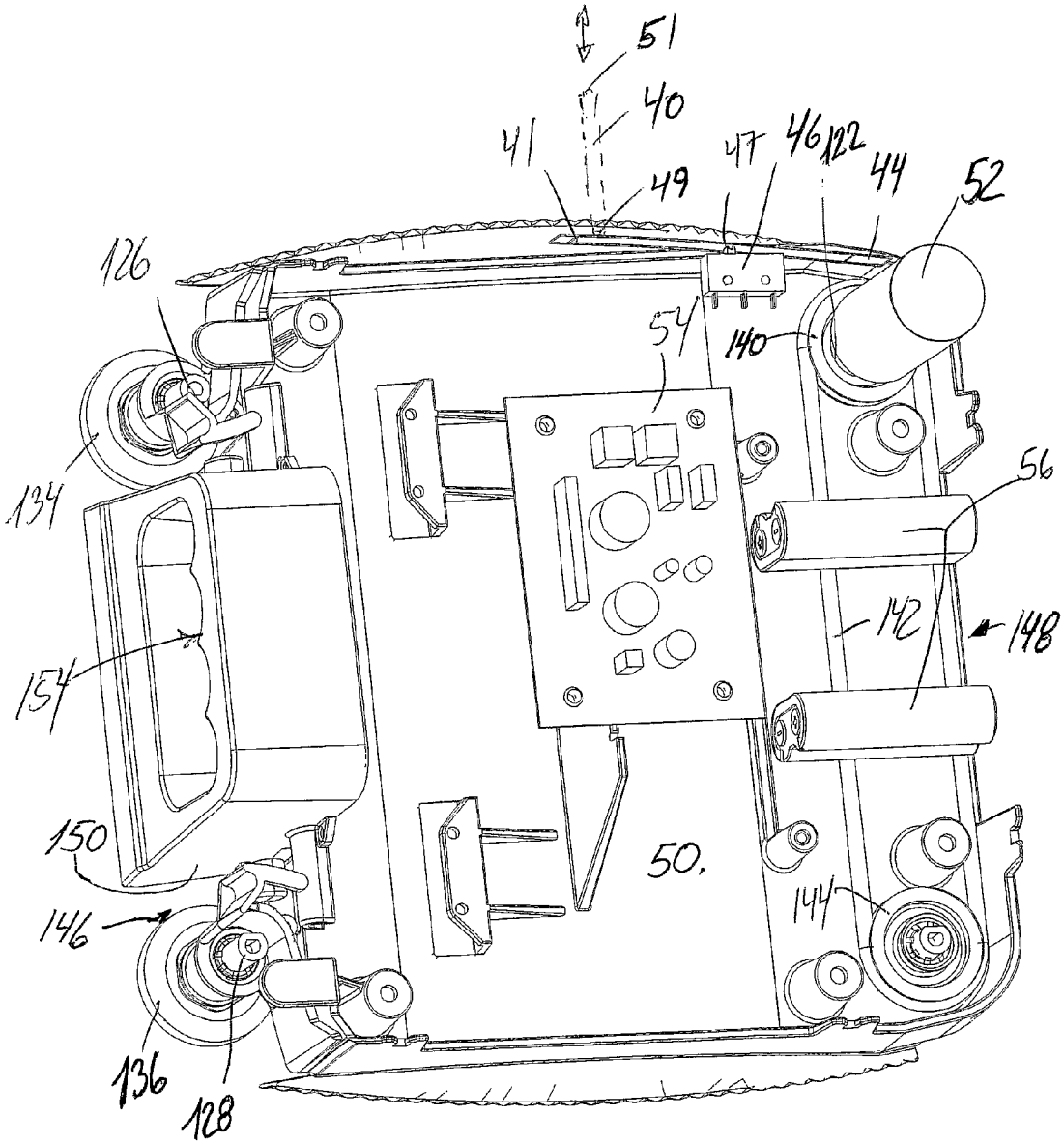
FIG. 10 is a plan view of the traction unit/carriage shown in FIG. 9.
Figure 11:
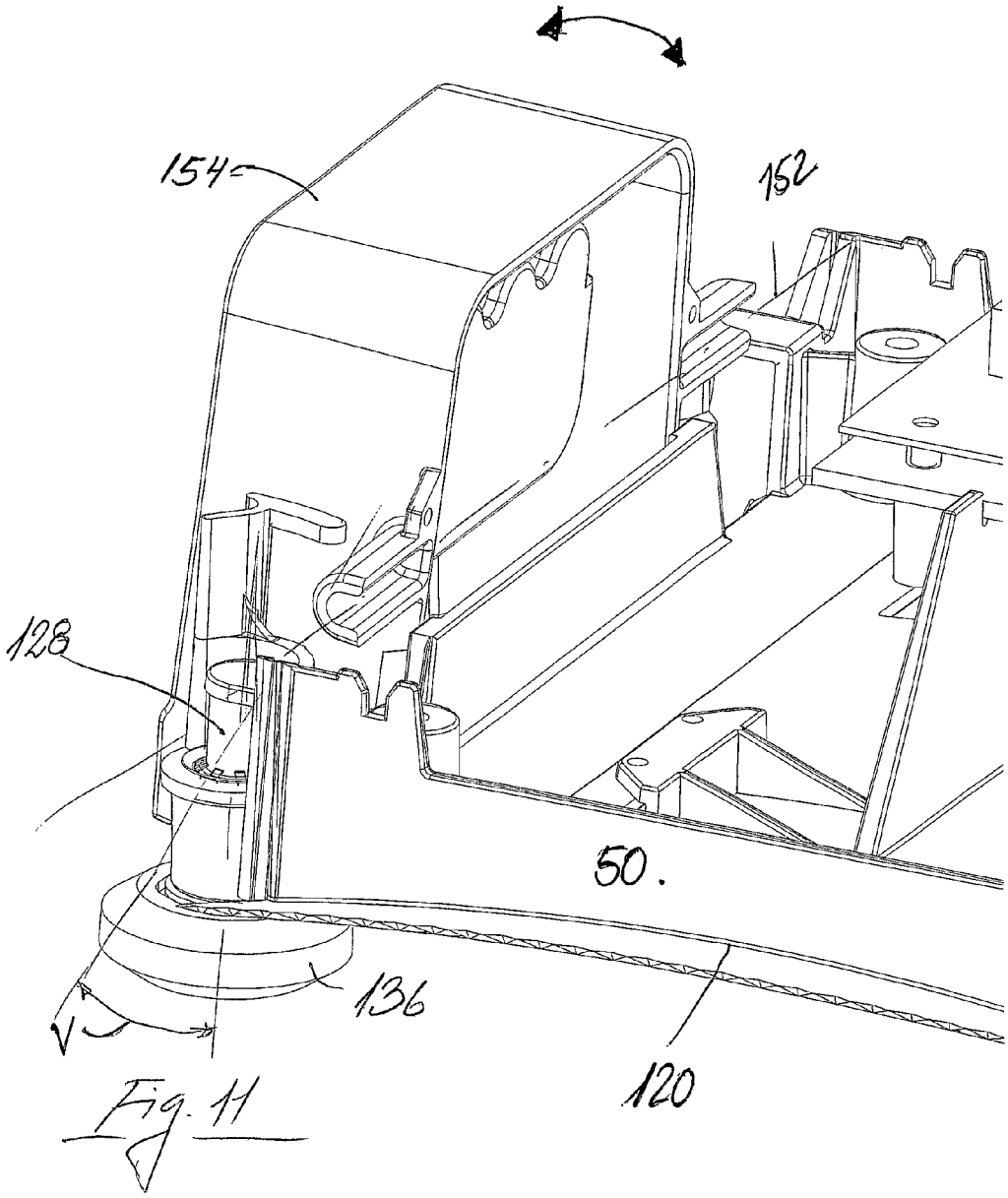
FIG. 11 is detail perspective view of a section of the left side of the traction unit/carriage shown in FIG. 10.

As will further appear from FIGS. 8-10, the chassis 50 comprises an electrically driven motor 52 which, via a switch, which in the illustrated embodiment, is comprised of a microswitch 46, and is connected with a re-chargeable current source 56 via a control unit 54. The control unit 54 is used for controlling the re-charging of the current source 56 at an externally-placed charging unit 30, but the control unit 54 can also be used for controlling the operation of the drive motor 52, for example, the control unit 54 can be arranged with a "delay" in the closing of the circuit to the drive motor 52 after the microswitch is deactivated. In an embodiment that is not shown, and on the basis of data collected from relevant signal generators and via suitable wireless signal transmitters, the control unit 54 can stand in connection with a main control unit which has overriding control over the operation of the respective drive motors 52 of the traction units/carriages 10.

The drive shaft (not shown) of the drive motor, the one of the vertically disposed axles 122 via a friction connection (not shown), and on which vertical axle there is also provided a first drive wheel 140, which via a drive connection 142 is connected to a corresponding second drive wheel 144 on the axle 124 on the same side of the chassis 50. The function of the switch and its interaction with the displaceable pin 40 in the housing 12 has already been described.

The support wheels 134, 136, which are mounted on the axles 126, 128, are arranged on the side of the chassis opposite the side 148 with the drive wheels 130, 132. As will be seen from FIGS. 8-10, the support wheel axles 126, 128, are placed in a lockable part 150 of the chassis side 146. The lockable part 150 can be swung out around a horizontal axis 152 disposed substantially parallel with the chassis side 146 and above the support wheels 134, 136, whereby it becomes possible to carry out a swinging-out of the support wheels 134, 136 so that these, in the placing/mounting of the traction unit/carriage 10 on the track 6, can pass the first and second side edges 70, 72 of the side surface 66, thus making it possible to mount the traction unit/carriage 10 on the track without the necessity of having to carry out a time-consuming separation of one or more of the track's elements 8, 8', 8", 8'" a procedure which would also make it necessary to take the arrangement out of operation.

As also is apparent from the embodiment shown in FIGS. 8-10, the lockable part 150 comprises a manually operated element for use in connection with the releasing and swinging-out of the lockable part 150 at an angle in relation to the substantially vertical locked position, cf. FIG. 8

As will appear from FIGS. 7 & 9, the rechargeable current source 56 is placed in a enclosure 156 in the chassis 50, the outer side 158 of which is extends through one of the sides 160 of the housing 12 which is oriented parallel with one of the long sides of the track element, and as already mentioned, the outer side 158 of the enclosure 156 comprises contact surfaces 58 which cooperate with the contact surfaces 60 on a cooperating external charging unit placed at a relevant long side 62 of the track element 6, cf. FIGS. 3 & 13.

The arrangement 2 according to the invention can further comprise predetermined stopping places where it is desired that the traction units/carriages 10 shall be brought to a halt, for example, at places where the upright-standing expansion pelt boards 4 placed in the housing shall be removed from the traction unit/carriage 10 and others inserted, for which use can naturally be made of rail bracket 32, as is shown in FIGS. 3 & 13, comprising an arm 38 displaceable by a first actuator 36, said arm 38 being displaceable between an active position in which it extends transversely relative to the track 6, on a level with the outstanding part 34 on the front of the housing 12, and a passive position outside the track and area of action of the traction unit.

Figure 12:
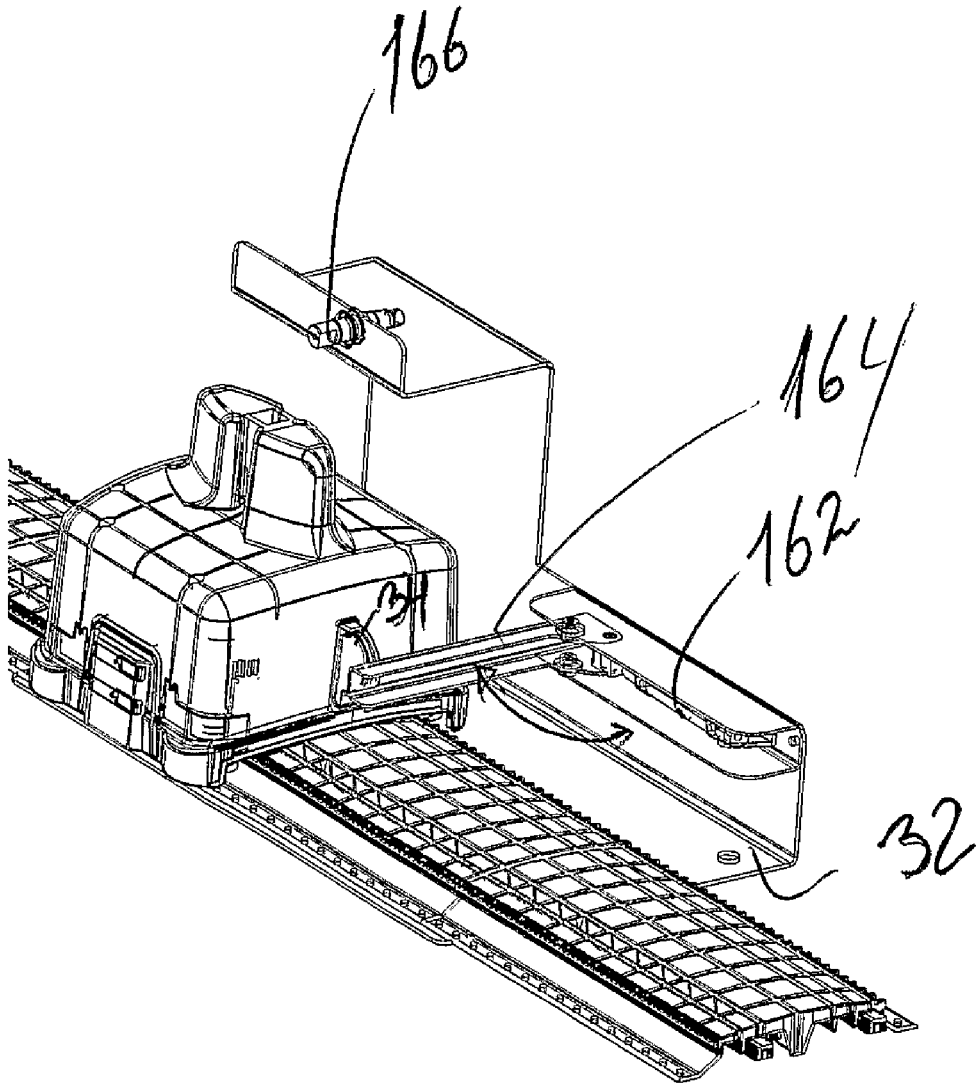
FIG. 12 is a perspective view of a track section with a traction unit/carriage, and a stop unit with a detector for expansion pelt boards.

However, the arrangement can also be provided with a stop arrangement as shown in FIG. 12, where there is a releasably connectable rail bracket 32 at the side of the track element. An actuator 162, which is connected to a pivotally-mounted arm 164 at the same level as the displaceable pin 40 in the part 34, is provided on the rail bracket 32. The pivot arm 164 is displaceable between a first active position, where the arm 164 is outside the track element and the area of operation of the traction unit/carriage 10, and a second active position where the arm 164 is oriented transversely relative to the track element 6, as shown in FIG. 12.

As is also apparent from FIG. 12, the rail bracket 32 also comprises a sensor/detector unit 166 with a signal generator for the detection of the shape to which upright-standing expansion pelt boards 4 are placed in the housing 12 on a relevant traction unit/carriage 10 which has been stopped by the stop arrangement. The object of the sensor/detection unit 166 is to achieve the possibility of providing a better control of the machines and namely the handling units which are used in association with the arrangement for transport of expansion pelt boards in the upright position. This can be achieved by connecting the signal generator of the detection unit to a central or de-central control unit which controls the operation of most of the machines set up in a pelt processing plant in association and for cooperation with the arrangement for transport according to the invention.

Figure 14:
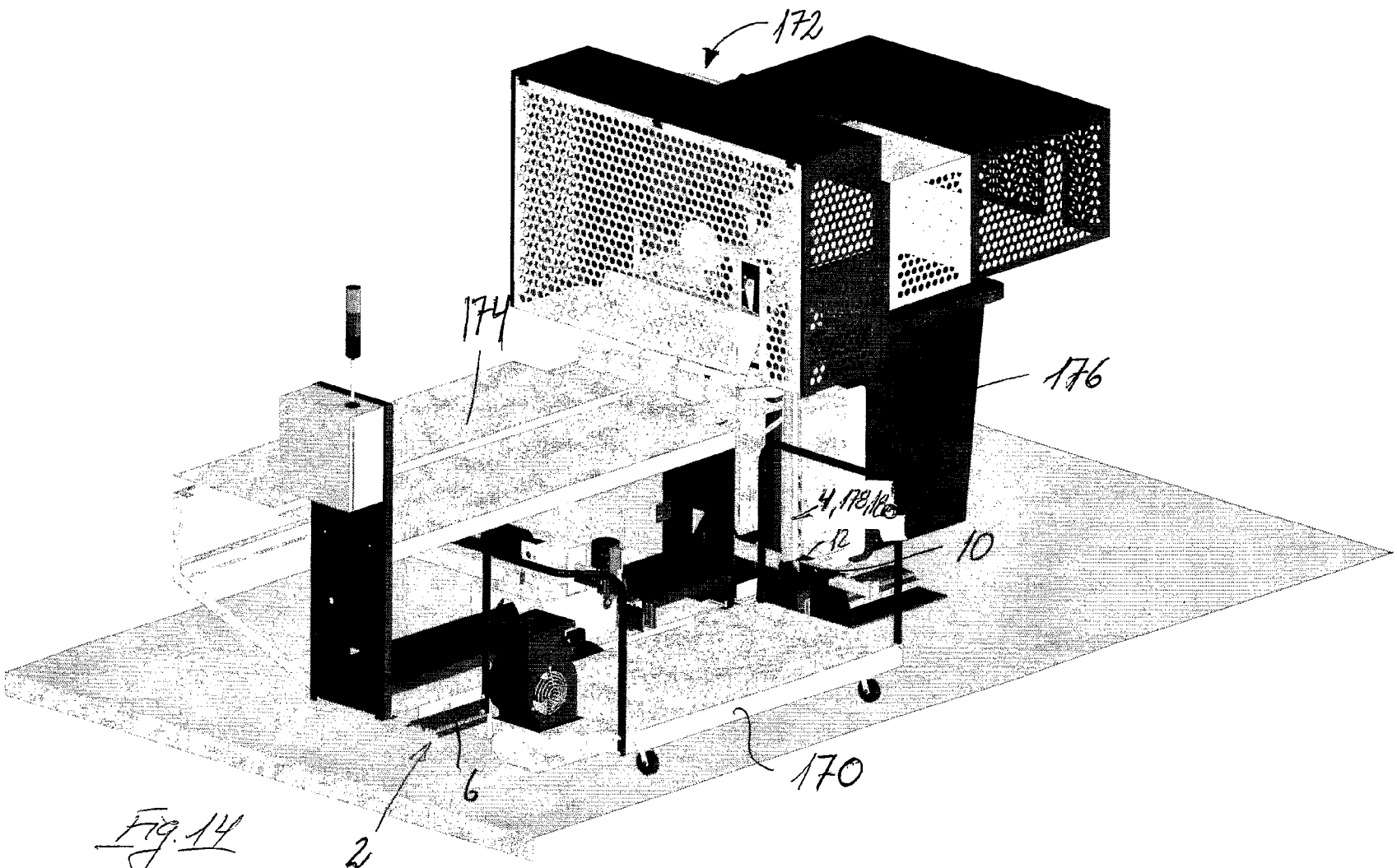
FIG. 14 is a perspective view of a part of a pelt-handling/processing plant in which the arrangement according to the invention forms part for the transport of upright-standing pelt boards.

In FIG. 14, there is shown a section of a pelt processing plant in which the arrangement 2 according to the invention is used as a transport unit between a drying unit 170 and a pelt removing machine/pelt remover 172, with a packing table 174 for packaging of the pelts (not shown) removed from the expansion pelt boards, and with a collection container 176 for collection of the holding bags 178 and fat-absorbing pelt inner bags (if such bags are used) which are remaining after the pelts are removed from the boards. As can be seen, the track 6 of the transport arrangement extends between the drying unit 170 and the pelt removing machine 172, and a carriage 10 is seen driven to a position opposite the pelt removing machine 172, ready for the removal of a an upright-standing expansion pelt board 4 with a taned, dried pelt 180 from the carriage on the chassis 12.

In conclusion, it shall be mentioned that the inventor has acknowledged that the arrangement for the transport of upright-standing expansion pelt boards can also be used for the transport of pelt boards of other types, merely providing that these have a stiff part extending from the foot end of the board, and which has a geometry which cooperates with the opening 14 in the housing/over-structure 20 on the traction units/carriages 10. The inventor has further acknowledged that the opening in the housing can assume configurations other than the configurations described above, and which will thus be adapted for the accommodation of any stiff part whatsoever extending from the foot end of a relevant expansion board, for the securing of the expansion board in the upright position during transport with a relevant traction unit.

What is claimed is:

1. Mink/fox transportation system for individual transfer/transport in connection with production of mink/fox pelts between stations for any one or more of transport, handling and processing, comprising:

a predetermined transport path in the form of a track which is formed of track elements assembled together, and at least one self-driven carriage unit that is drivable along said transport path, said at least one carriage unit comprising a chassis with a releasably mountable over-structure arranged for individual transfer/transport of mink/fox pelts, wherein the track elements comprise a plurality of shell-shaped, flattish, elongated track elements assembled together in a path adapted to the configuration of a particular facility, said elements comprising a first end side, a second end side, a first long side, a second long side, and an upwardly-facing surface with an upwardly convex shape that is symmetrical with respect to a centerline thereof between and at a level above said sides, said upwardly-facing surface having first and second side edges, and where the first and second long sides comprise support flanges for contact against a fixed under layer, and where the first and second long sides have a first and a second open, substantially V-shaped track between the support flanges and the first and second sides edges of the upwardly-facing surface, the track having a smaller straight portion which is oriented substantially parallel with an imaginary vertical plane through said centerline, and wherein a larger first side surface portion of the V-shaped track slopes downward from said straight portion to a connection with a respective support flange, and where a second side surface of the V-shaped track slopes from the straight portion to a connection with an edge of a respective one of the first long side and the second long side of the upwardly-facing surface.

2. Mink/fox transportation system according to claim 1, wherein downwardly facing surfaces of the track elements are provided with longitudinal and transverse stiffening ribs.

3. Mink/fox transportation system according to claim 1, wherein the support flanges comprise recesses or cut-outs for receiving securing means for fastening of the track to the fixed under layer.

4. Mink/fox transportation system according to claim 1, wherein the upwardly facing surface of the track elements has recesses along the first and second sides edges.

5. Mink/fox transportation system according to claim 1, wherein the at least one carriage unit comprises a substantially rectangular, plate-shaped chassis having a side facing towards the track element which has an upwardly convex shape that is substantially congruent with the convexly curved top surface of the track elements, said chassis comprising a substantially vertical axle near each corner thereof, first ends of the substantially vertical axle bluntly extending down under the chassis, wherein said first ends are provided with substantially horizontal drive wheels and support wheels which cooperate with the V-shaped track, wherein said horizontally-oriented wheels have a cross-sectional geometry which corresponds substantially to that of the V-shaped track, and wherein said chassis further comprises an electrically driven drive motor which, via a switch, is connectable to a rechargeable current source, wherein the axle of said drive motor is connected to one of the vertical axles via a friction connection, and wherein a first drive wheel on said vertical axle is connected via a drive connection to a corresponding second drive wheel on the same side of the chassis.

6. Mink/fox transportation system according to claim 5, wherein the support wheels are placed on a side of the chassis opposite the side with the drive wheels, and wherein the support wheels are housed in a lockable part, said lockable part being mounted to be swingable out around an axis above the support wheels that is disposed horizontally and substantially parallel with the chassis side facing towards the track element.

7. Mink/fox transportation system according to claim 6, wherein the lockable part comprises a manually-operated element for releasing and swinging-out of the lockable part at an angle in relation to the substantially vertical locked position.

8. Mink/fox transportation system according to claim 7, wherein the rechargeable current source is located within an encapsulation in the chassis, an outer side of current source protruding through a sides of the chassis which is oriented parallel with one of the long sides of the track element, and wherein the outer side of the encapsulation comprises contact surfaces which cooperate with contact surfaces on a cooperating external charging unit located at a long side of at least one of the track elements.

9. Mink/fox transportation system according to claim 8, wherein the current source further comprises a first control unit for controlling recharging of the rechargeable current source by the external charging unit.

10. Mink/fox transportation system according to claim 9, wherein the carriage unit comprises a second control unit for controlling the drive motor and other mechanical functions related to the over-structure on the carriage unit.

11. Mink/fox transportation system according to claim 5, wherein the switch comprises a microswitch which is activated and deactivated via a piece of spring steel which is housed in the chassis and is positioned to make contact with an activation point of the microswitch, wherein a free end of the spring steel piece is in contact with a first end of a pin housed in a displaceable manner in the chassis, and wherein a second end of said pin extends out of a projection on the chassis as a foremost point of the carriage unit.

12. Mink/fox transportation system according to claim 11, wherein a side of the chassis opposite the side with protruding second end of the pin in the projection is approximately vertical.

13. Mink/fox transportation system according to claim 11, wherein at one of the long sides of the track elements there is provided at least one lockable, fastenable rail bracket on which there is a displaceable arm which is activatable by an actuator and which is at the same height as the pin, and wherein said displaceable arm is displaceable between a first inactive position, where the arm is disposed outward of the track element and area of operation of the carriage unit, and a second active position where the arm is oriented transversely to the track element in a position to contact the protruding second end of the pin.

14. Mink/fox transportation system according to claim 13, wherein the rail bracket further comprises a detection unit for detecting an upright-standing expansion pelt boards on the chassis of a respective carriage unit.

15. Mink/fox transportation system according to claim 13, wherein at a distance from the displaceable arm and at a side of the track element, there is at least one charging station for the charging of the rechargeable current source.

16. Mink/fox transportation system for individual transfer/transport in connection with production of mink/fox pelts between stations for any one or more of transport, handling and processing, comprising:

a predetermined transport path in the form of a track which is formed of track elements assembled together, and at least one self-driven carriage unit that is drivable along said transport path, said at least one carriage unit comprising a chassis with a releasably mountable over-structure arranged for individual transfer/transport of mink/fox pelts, wherein the respective track elements comprise mutually cooperating locking means for assembly and fastening thereof into the track, and the track elements comprise a plurality of flattish, elongated track elements having a convexly curved top surface, wherein the cooperating locking means are constituted by channels formed in first end sides of the elongated, flattish elements for the introduction of tongues protruding from second end sides of adjoining elements, and by locking tongues on at least two opposing side surfaces, and wherein sides of the locking tongues and of the channels facing the sides of the locking tongues comprise cooperating serrations.

17. Mink/fox transportation system according to claim 16, wherein, for transporting of pelt boards in an upright-standing position, said pelt boards having a nose end and a foot end, an upwardly-facing side of the over-structure comprises an opening for receiving of a smaller part of the foot end of the pelt board.

18. Mink/fox transportation system according to claim 16, for transport of pelt boards in upright-standing position, wherein said pelt boards comprise a nose end and a foot end with at least a blunt part extending from the foot end of the pelt board oriented in a longitudinal direction of the pelt board, and wherein an upwardly-facing side of the over-structure comprises an opening which is arranged to receive the blunt part extending from the foot end of the pelt board.

19. Mink/fox transportation system according to claim 16, for transport of upright-standing expansion pelt boards, wherein said expansion pelt boards comprise a nose end, a foot end, and a locking and distension element with a blunt part extending from the foot end and having an engaging area for a holding means, wherein an upwardly-facing side of the over-structure has an opening which is arranged for receiving the blunt part extending from the foot end of the expansion pelt board.

* * * * *